US005895275A

United States Patent [19]

Harbertson

[11] Patent Number: 5,895,275

[45] Date of Patent: Apr. 20, 1999

[54] ELECTRIC OUTLET EXTENDER

[76] Inventor: Grant J. Harbertson, c/o Quick Connections, 50 S. Main, No. 25, Ste. 10, Salt Lake City, Utah 84144

[21] Appl. No.: 08/550,761

[22] Filed: Oct. 31, 1995

[51] Int. Cl.[6] ..... H01R 4/60

[52] U.S. Cl. ..... 439/21; 439/32

[58] Field of Search ..... 439/13, 20, 21, 439/22, 27, 32, 110, 115, 120, 210, 211

[56] References Cited

U.S. PATENT DOCUMENTS

| | | | |
|---|---|---|---|
| D. 324,669 | 3/1992 | Co | D13/140 |
| 3,815,078 | 6/1974 | Fedrick | 439/501 |
| 4,245,873 | 1/1981 | Markowitz | 439/32 |
| 4,875,871 | 10/1989 | Booty et al. | 439/210 |
| 5,041,002 | 8/1991 | Byrne | 439/211 |
| 5,052,937 | 10/1991 | Glen | 439/120 |
| 5,067,906 | 11/1991 | Woodgate | 439/115 |

*Primary Examiner*—Neil Abrams
*Assistant Examiner*—T C Patel

[57] ABSTRACT

An electric outlet extender with a male plug at one end to be connected into a wall outlet and a female electrical outlet at an opposite end and with a first tubular telescoping member rotatably connected to the male plug and a second telescoping member extending from the female outlet to telescope into the first telescoping member whereby the extender can be plugged into a wall outlet, turned to any desired angle and extended to desired length while hugging the wall.

7 Claims, 3 Drawing Sheets

ELECTRIC OUTLET EXTENDER

BRIEF DESCRIPTION OF THE INVENTION

1. Field of the Invention

This invention relates to devices to extend the effectiveness of electrical wall outlets. It is particularly concerned with rigid extension devices that effectively move an outlet from a difficult to reach and use location to a convenient location for the coupling of extension cords, and electrical devices.

2. Prior Art

Extension cords are widely used as devices to effectively extend electrical outlets from a fixed location in a wall to a remote location where art electrically powered device can be attached and used. Such cords are flexible and have a plug on one end to be plugged into a wall outlet and an outlet on the other end of the cord into which a male electrical plug can be inserted. While they may work reasonably well in situations where the cords are allowed to fall as they may, after insertion of the male plug end into a wall out let and movement of the female receptacle end to a desired location they are unsightly and in some instances may constitute traffic hazards.

Various special configurations of extension cords have been proposed in the past. Some are intended to prevent the sprawling flexible cord and the hazards associated therewith and others recognize a need to have a flat cord that will extend an electrical wall outlet to a remote location. U.S. Design Pat. No. 324, 669, for example, discloses an extension cord with a reel in a housing that will rest against a wall when the cord is plugged into a wall receptacle. A similar retractable extension cord unit is shown in U.S. Pat. No. 3,815,078. U. S. Pat. No. 4,708,094 discloses an extension cord of undercarpet flat cable with a flexible extension and male plug extending from one end of one member of a flat telescoping, conductive assembly, the other telescoping member of which has a female outlet fixed thereto.

There remains a need for a device that will plug into a wall out let and transmit power from such out let to a desired location, with the device hugging the wall so as not to be unsightly and constructed to be readily rotated with respect to the wall outlet so that a female outlet on the end remote from the male plug can be located directly above or below the wall outlet, to either side of the wall outlet or at any desired angle with respect to the wall plug.

OBJECTS OF THE INVENTION

It is not uncommon that when furniture is positioned in a building electrical wall outlets are hidden behind the furniture. It is also not uncommon that it is often desirable to connect electrically powered devices into the hidden and difficult to reach wall outlet. As previously noted this can be accomplished with the usual flexible extension cords. However the conventional extension cords are, at best, difficult to use where it is desired that the female outlet of the cord be held in an assigned raised position. For example, a wall outlet positioned behind the head of a bed cannot be easily accessed for the insertion of the plug of a lamp, clock, radio or other electrical device. Such electrical device may be positioned on a table at either side of the head of the bed or may be mounted on or in a headboard of the bed.

Accordingly, it is a principal object of the present invention to provide an electrical outlet extender that will plug into a wall outlet and having a telescoping, substantially rigid, conductor section that will pivot about the male plug inserted into the wall outlet to position a female outlet at a desired position relative to the wall outlet where the female outlet is conveniently accessed for receipt of the plug of one or more electrical devices.

FEATURES OF THE INVENTION

Principal features of the invention include a first substantially rigid, non-conductive, telescoping member having a male plug rotatably mounted or one end thereof and electrically connected to first flat electrical connectors extending the length of the first substantially rigid telescoping member.

A second substantially rigid, non-conductive, telescoping member telescopes within said first substantially rigid telescoping member and has second flat electrical connectors therein, with sliding contacts projecting therefrom to engage the first electrical connectors in the first substantially rigid telescoping member.

Additional objects and features of the invention will become apparent from the following detailed description and drawings, disclosing what is presently contemplated as being the best mode of the invention.

THE DRAWINGS

In the drawings:

FIG. 1 is a perspective view of the electric outlet extender of the invention;

FIG. 2, an exploded perspective view of the electric outlet extender;

FIG. 3, a sectional view through the plug of the extender, taken on the line 3—3 of FIG. 1; and FIG. 4, a sectional views, taken on the line 4—4 of FIG. 1.

DETAILED DESCRIPTION OF THE INVENTION

Figure 1:
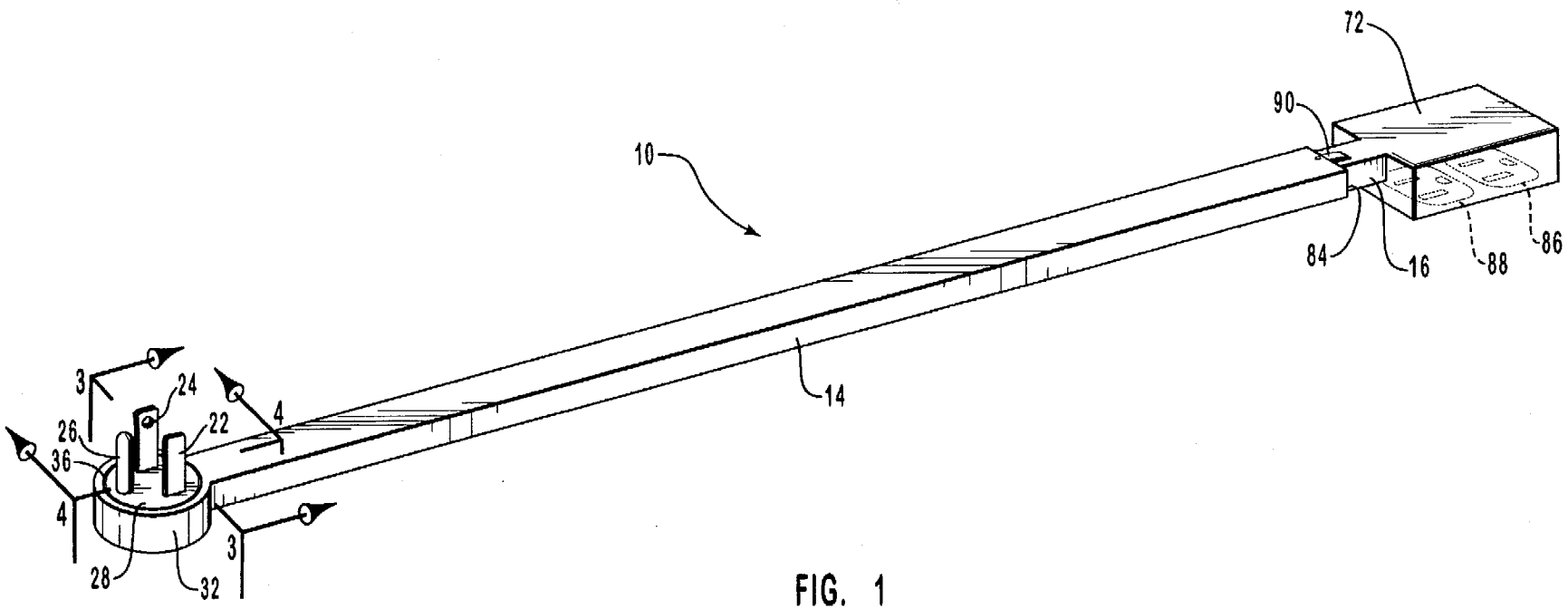
Figure 2:
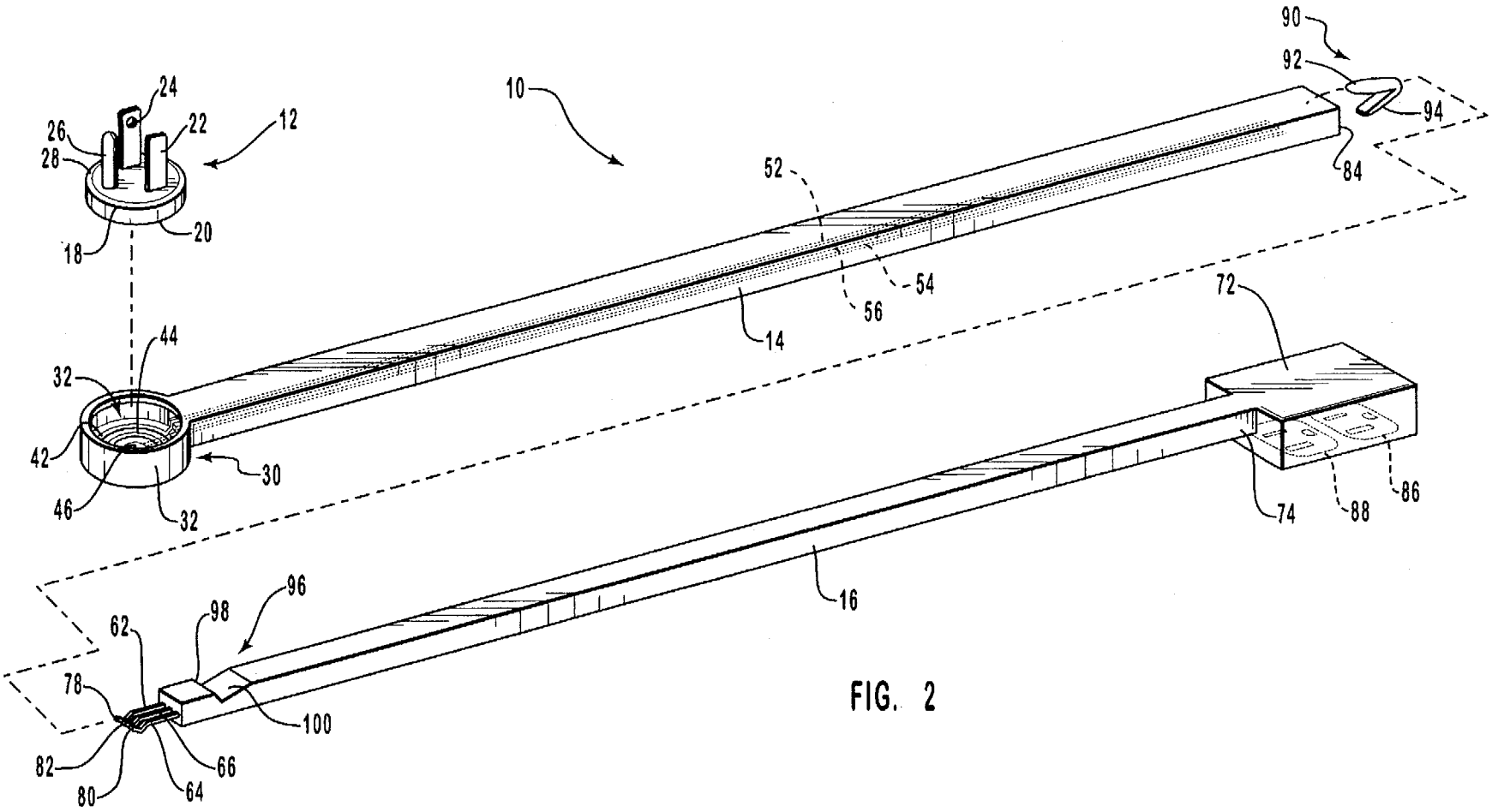
Figure 3:
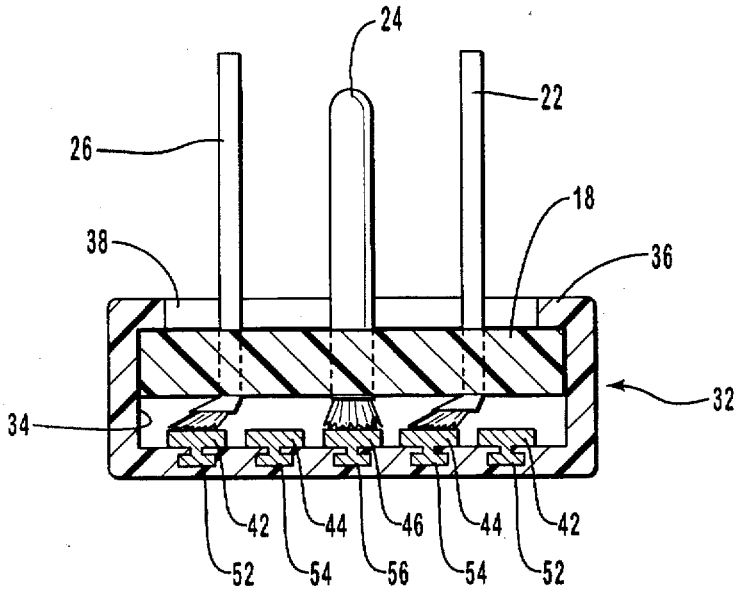
Figure 4:
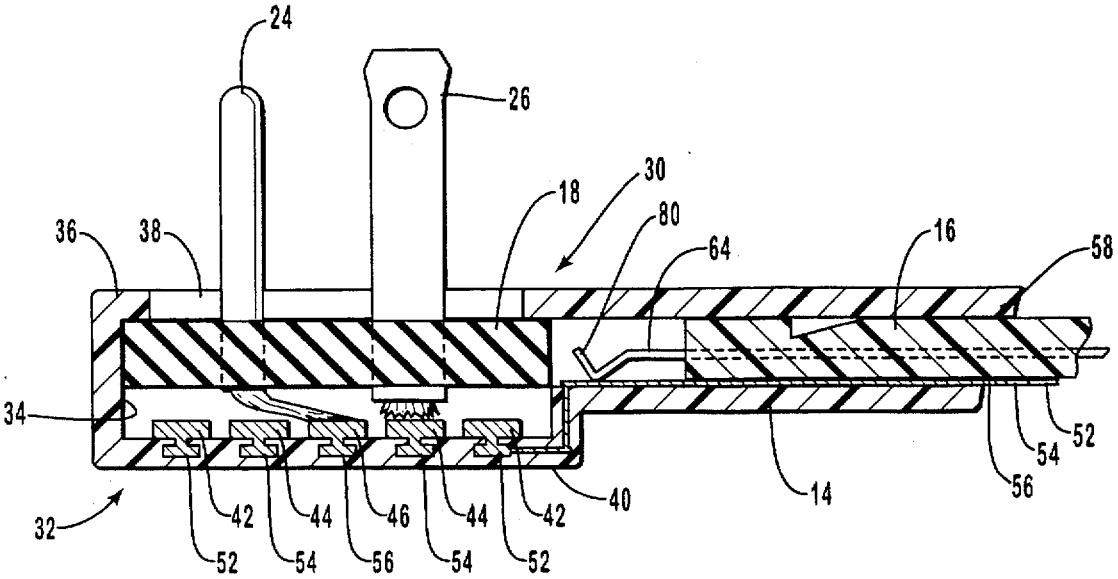

Referring now to the drawings:

In the illustrated preferred embodiment of the invention, the electric outlet extender is shown generally at 10.

Electric outlet extender 10 includes a male plug assembly 12, a first substantially rigid, non-conductive, tubular telescoping member 14 and a second substantially rigid, non-conductive telescoping member 16.

Male plug assembly 12 has a base 18 with a circular outer periphery 20, molded, or otherwise formed from a non-conductive material such as rubber, plastic, composites, or the like. The usual contact prongs 22 and 24 and ground probe 26, such as are commonly associated with male plugs of electrical devices, project from one face 28 of the base 18. The prongs 22 and 24 and probe 26 are embedded in the base 18 and extend through the base to make electrical connections when the plug assembly 12 is snapped into one end 30 of the first electrically non-conductive telescoping member 14.

A socket 32, formed at the end 30 of the first telescoping member 14, has an interior circumference 34 just larger than the outer periphery of the base 18. An inturned lip 36 surrounds the open end 38 of the socket 32.

A bottom 40 of the socket 32 has concentric electrical contact members 42, 44, and 46 molded or otherwise placed therein to be respectively contacted by the contact prongs 22 and 24 and the ground probe 26 when the plug assembly 12 is snapped into the socket 32. Plug assembly 12 is forced through lip 36 arid into the socket 32 and is held in place by the lip. The plug assembly is rotatable within the socket, while maintaining engagement of the prongs 22 and 24 and ground probe 26 with the concentric contact members 42, 44 and 46. The close engagement of the interior circumference 34 with the outer periphery 20 of the base 18 and the pressure applied to the base 18 by the lip 36, while allowing rotation of the plug assembly 12 relative to the socket prevents undesired rotation of the socket 32 and the first telescoping member 14, once they have been positioned with respect to the plug assembly.

The concentric electrical contact members 42 , 44, and 46 are respectively corrected to flat, spaced apart conductor strips 52, 54, and 56 that extend through substantially the full length of a tubular housing 58 of the first telescoping member 14 at one side of the housing. The flat strips 52, 54, and 56 are molded into the socket 32 to engage the concentric contact members, without engaging the surfaces of such contact members engaged by the prongs 22 and 24 arid probe 26 of the plug assembly 12.

The second telescoping member 16 comprises a solid elongate bar with spaced apart conductors 62, 64, and 66 extending from one end 68 of the bar to a flat outlet housing 72 at the other end 74 of the bar. The conductors 62, 64, and 66 projecting from end 68 each are crimped at 76 to form V-shaped contacts 78, 80, and 82. The flat outlet housing 72 has a pair of electrical outlets 86 and 88 molded or otherwise affixed therein and the electrical outlets are each connected to the conductors 52, 64 and 66 in conventional fashion with the outlets 86 and 88 facing opposite to direction of projection of the prongs 22 and 24 and ground probe 26.

When assembled, the plug assembly 12 snaps into socket 32 and the end 68 of the second telescoping member 11 is tightly but slidably inserted into the end 84 of the tubular first telescoping member 12 with the contacts 78, 80, 82 respectively engaging the flat conductor strips 52, 54, and 56.

A U-shaped spring clip 90 has one leg 92 fixed to the end 84 of the first telescoping member 14 and another leg 94 extending into the tubular first telescoping member where it will engage the second telescoping member 16 as the second telescoping member reciprocates in the first telescoping member. The leg 94 also extends into a groove 96 formed in the end 86 of the second telescoping member 16 and engages an abrupt wall 98 of the notch to prevent withdrawal of the second telescoping member 16 from the first telescoping member 14. The sloped wall 100 of the groove 96 allows the leg 94 to be pulled from groove 96 as the second telescoping member 16 is pushed into the first telescoping member 14.

In use, the prongs 22 and 24 and ground probe 26 are inserted into a wall outlet, the telescoped first and second telescoping members 14 and 16 are rotated about the plug assembly 12 to extend in a desired direct ion and member 16 is pulled from member 14 to position the outlets 86 and 88 at a desired location to receive the plugs of electrical devices to be powered.

It will be apparent that more than two telescoping members car be provided for the electrical extender 10 of the invention as may be necessary to provide a device capable of reaching a greater range of distances from the wall outlet.

Although a preferred form of my invention has been herein disclosed it is to be understood that the present disclosure is by way of example and that variations are possible without departing from the subject matter coming within the scope of the following claims, which subject matter I regard as my invention.

I claim:

1. An electric outlet extender comprising a plug assembly including a male plug assembly with a pain of electrical prongs and a ground probe projecting from a face of an electrically non-conductive base;

a first substantially rigid, tubular, non-conductive, telescoping member having one end connected to the base and rotatable with respect to said base around said electrical prongs and ground probe;

a second substantially rigid, non-conductive, telescoping member having one end snugly inserted into an opposite end of said first telescoping member;

at least one female electrical outlet fixed to the other end of the second telescoping member; and electrical connector means interconnecting each said outlet with said electrical prongs and ground probe through said base and said first and second telescoping members.

2. An electric outlet extender as in claim 1, wherein the base has a circular periphery arid is tightly fitted into a socket at one end of the first telescoping member.

3. An electric outlet exterder as in claim 2, wherein the electrical prongs and probes extend through the base; the socket has a circular inner wall in engagement with the periphery of the base arid concentric electrical contact members each in engagment with one of said prongs and probe.

4. An electric outlet extender as in claim 3, wherein the socket has a flexible lip holding the base in the socket and the electrical prongs and probe in engagement with the concentric electrical contact members of the socket.

5. An electric outlet extender as in claim 4, wherein the electrical connector means includes spaced apart conductor strips each having an end connected to one of said concentric electrical contact members and extending through the tubular first telescoping member, and spaced apart connector members extending from each female outlet, through said second telescoping member at the end remote from the female outlets to terminate in contacts each engaging one of said spaced apart conductor strips in the first telescoping member.

6. An electric outlet extender as in claim 5, further including means to prevent withdrawal of the second telescoping member from the first telescoping member.

7. An electric outlet extender as in claim 6, wherein said means to prevent withdrawal of the second telescoping member from the telescoping member increases friction between said first and second telescoping members.

* * * * *